United States Patent [19]

McDuff

[11] Patent Number: 4,651,991

[45] Date of Patent: Mar. 24, 1987

[54] HANDLE COVERING

[76] Inventor: Michael A. McDuff, P.O. Box 717, Del Rio, Tex. 78841

[21] Appl. No.: 808,098

[22] Filed: Dec. 12, 1985

[51] Int. Cl.[4] ..... A63B 61/00

[52] U.S. Cl. ..... 273/75; 273/81.5

[58] Field of Search ..... 273/73 R, 73 J, 75, 273/67 R, 81 R, 81.4, 81.5, 81.6, 81 D, 72 R, 72 A, 81 B, 165; 74/551.8, 551.9, 558, 558.5; 43/23; 116/110 R, 116 R, DIG. 12; 81/177.1, 489; 128/165, 166

[56] References Cited

U.S. PATENT DOCUMENTS

| | | | |
|---|---|---|---|
| 1,995,750 | 3/1935 | Salley | 273/81.5 |
| 2,009,969 | 7/1935 | Hampton | 273/81.5 |
| 2,200,626 | 5/1940 | Lamkin | 273/81.6 |
| 3,614,100 | 10/1971 | Spitz | 273/75 |
| 3,845,954 | 11/1974 | Case | 273/81.5 X |
| 4,133,529 | 1/1979 | Gambino | 273/81 R |
| 4,159,115 | 6/1979 | Ticktin et al. | 273/75 |

FOREIGN PATENT DOCUMENTS

| | | | |
|---|---|---|---|
| 23427 | of 1911 | United Kingdom | 273/81.5 |

*Primary Examiner*—Richard C. Pinkham
*Assistant Examiner*—Matthew L. Schneider
*Attorney, Agent, or Firm*—Norman B. Rainer

[57] ABSTRACT

A secondary covering for the gripped portion of manipulative handles having a primary non-slip covering is comprised of an elongated strip of terrycloth fabric having a doubly convergent taper at each extremity and two lengths of strong thin tether line attached to each extremity. The covering is adapted to be wound in spiral fashion about the handle, both extremities being secured by the tether lines to the handle, the tether lines of the upper extremity of the winding being secured with plastic adhesive tape. By virtue of its construction and manner of application, the covering provides a cushioned gripping surface relatively unaffected by moisture, and preserving the natural "feel" of the handle.

9 Claims, 3 Drawing Figures

HANDLE COVERING

BACKGROUND OF THE INVENTION

1. Field of the invention

This invention is concerned with a secondary covering for the gripped portion of manipulative handles having a primary leather or rubber covering, and is particularly applicable to shaft-like handles for athletic apparatus such as golf clubs and tennis rackets, and handles of apparatus such as bicycles and motorcycles.

It is extremely important that the grip of the handle of such apparatus be designed so that, even when under humid, moist conditions, the handle will not slip in or from the user's hand, and that it will not require undue strength to retain the apparatus comfortably under control. It is also highly desirable that this be accomplished without interfering with the natural "feel" of the manipulative characteristics of the apparatus.

One of the most important factors tending to reduce the frictional gripping force between the user's hand and the handle of the apparatus, especially in the case of golf clubs and tennis rackets which are utilized in relatively hot weather conditions, is the moisture and oil emanating from the palm of a player's hand. Many of the various means previously employed to increase the friction between the hand of the user and the surface of the handle have employed substances which are, or in use become tacky, and therefore tend to accumulate grimy deposits on the handle. Even those grips that are initially smooth and non-sticky tend to accumulate deposits over a period of use.

It is also highly desirable that the grip of the handle be comfortable in the hands of the user so that he is not distracted from his concentration on the operation of the apparatus or the playing of the game in the case of sports apparatus. Therefore, the means that are utilized for obtaining a slip-free grip should not destroy the natural "feel" nor the comfort that a player desires in athletic apparatus.

Another desirable consideration is that the grip of the handle of the apparatus be designed in a way that gives flexibility of styling, especially in color, for the handle of the apparatus.

2. Prior Art

Many different approaches have been tried in the past to accomplish one or more of the desired ends previously mentioned with only varying degrees of success. In most cases, if one sought goal is secured with a reasonable degree of success, it has been done without accomplishing other ends or at the sacrifice of other desirable characteristics in the handle grip.

In U.S. Pat. No. 3,845,954 to Case, there is disclosed a non-slip covering for the handle of a tennis racket comprising a strip of adhering tape spirally wound onto the handle and a covering layer of a spirally wound strip of textile material. One extremity of the textile strip is anchored to the handle by means of a screw that enters the handle, the other extremity being anchored by means of an elastic lanyard having a hook that engages a hole in the strip. Consequently, the Case hand grip is not only difficult to apply to a handle, but requires anchoring means that may injure the user's hand, and is not adaptable to handles that cannot accept a wood screw.

U.S. Pat. No. 3,614,100 to Spitz concerns a removable sleeve for a racquet handle comprising an inner elastic tube covered by an outer tube of terrycloth.

Such construction appears to permit puckering and slipping under the stress of torsional forces and is likely to alter the "feel" of the handle.

U.S. Pat. No. 4,133,529 to Gambino discloses a grip that fits around a golf club handle comprising a terry-cloth sleeve closed at one end and having an adhesive collar at the other end. The Gambino grip appears to require customized fitting to particular handles, and lacks stability under torsional stress without use of a rubberized inner liner.

U.S. Pat. No 4.159,115 to Ticktin et al concerns a grip for a handle comprising a first spirally wound strip having stubble members, and a second spirally wound terry-cloth strip anchored to the first strip. The first strip is attached to the handle by adhesives or mechanical fasteners. Elastic loops are placed above each extremity of the terry-cloth winding to prevent its unwinding. The considerable bulk of such construction would appear to alter the "feel" of the handle.

It is accordingly an object of the present invention to provide a grip-improving, and appearance-modifying secondary covering capable of being applied to handles of varied shape having a primary non-slip covering without altering the natural "feel" of the handle.

It is another object of this invention to provide a covering of the foregoing object which minimizes the effects of moisture upon the frictional forces enabling the user's hand to controllably grip the handle.

It is a still further object of this invention to provide a covering of the aforesaid nature which can attach in either of two reversed positions to said handle without modification thereof.

It is yet another object of the present invention to provide an inexpensive washable covering of the aforesaid nature which can be applied to and removed from handles with a minimum of effort.

These objects and other objects and advantages of the invention will be apparent from the following description.

SUMMARY OF THE INVENTION

The above and other beneficial objects and advantages are accomplished in accordance with the present invention by a secondary covering for a handle comprising an elongated strip of terrycloth fabric having a doubly convergent taper at each extremity and two lengths of strong, thin tether line attached to each extremity. A strip of narrow plastic adhesive tape is used to complete the attachment of the covering to a handle.

In preferred embodiments, the strip has a uniform width of between about ½" and 1½", and a length between about 25" and 50". A triple overlocking stitch is applied about the entire perimeter of the strip to prevent unravelling. Other stitching techniques capable of providing the same results are the zig-zag and safety surge stitches. The tether line is preferably a heavy denier continuous multifilament crimped synthetic yarn such as an acrylic carpet yarn capable of compressing onto and frictionally engaging a primary covering such as leather or rubber. The yarn is preferably attached by sewing, serving, or knotting to the tapered extremities. The adhesive tape is preferably of about ¼" width and has elastic characteristics to facilitate conformation to irregular contours of the handle or covering. Such tapes are generally available, fabricated of plasticized vinyl compositions.

The covering is adapted to be spirally wound onto a handle beginning at either extremity of the strip, and accordingly either surface of the strip will be outwardly directed as the gripping surface. The terrycloth preferably has a velour surface on one side and a rough surface on the opposite side, thereby providing the user with an optional choice of texture preference. Terrycloth is a cotton fabric woven with loops on the surface that help absorb water. It is woven with one tight and one loose set of warp yarns. A filling yarn woven in between the two sets is pulled into loops. Terrycloth is often called Turkish towelling and is used chiefly for towels. The terrycloth useful in the present invention has a basis weight between about 10 oz. and 15 oz. per square yard. In order to preserve the natural "feel" of the grip while still providing a cushioning effect, it has been found that the thickness of the terrycloth should be between 0.01 and 0.03 inch.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
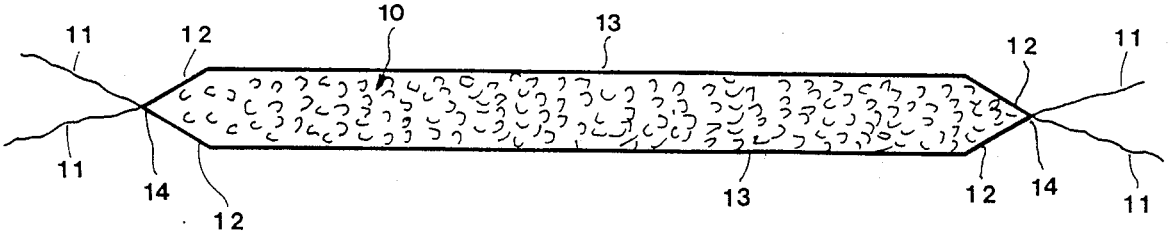
FIG. 1 is a top plan view of a secondary handle covering of the present invention.

Referring to FIG. 1, the handle covering of the present invention is shown comprised of an elongated strip 10 of terrycloth material, the tether lines 11 affixed to the extremities of said strip. A tapered portion 12 is associated with such extremity of the strip. The entire perimeter of the strip 10 including the tapered portions 12 is provided with a triple over-locking stitch to prevent unravelling.

Figure 3:
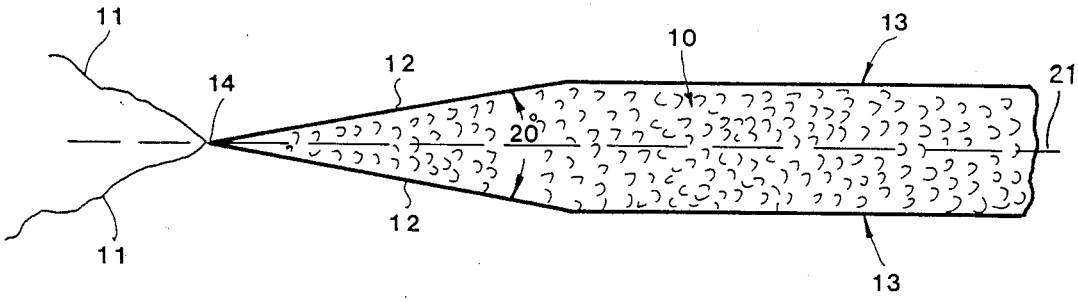
FIG. 3 is an enlarged fragmentary view of one extremity of the covering of FIG. 1.

As shown in FIG. 3, the nature of tapered portions 12 is such that the edges of the strip are angled away from straight parallel side edges 13 and inwardly directed to form an apex 14 located on the longitudinal center or midline axis of the strip represented by dashed line 21. The apex has an angle of about 20 degrees centered upon said axis. The length of the tapered portion will range between about 1½ and 5 inches, measured along said axis, for strips having widths between ½ and 1½ inches, respectively, said width being the perpendicular distance between side edges 13. The tether lines are attached to each apex and have a length approximately 2½ times the length of the tapered portion.

Figure 2:
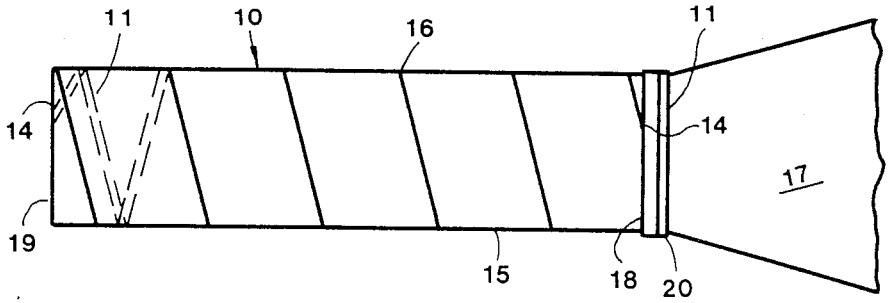
FIG. 2 shows the handle of a tennis racket having the covering of FIG. 1 applied thereto.

In use, as shown in FIG. 2, one apex extremity 14 of the strip is applied at the free bottom extremity 19 of the handle 15 to be covered. The tether lines 11 are wrapped with tension about the handle, and the strip 10 is wound with tension in a spiral pattern 16 which covers and locks in place the tether lines 11 of the initially applied end of the strip. By virtue of the tapered portion 12, the spiral winding of the strip is perpendicularly disposed to the handle axis at the free bottom extremity of the handle. The nature of the spiral winding 16 may be such that successive wraps are either in contacting abutment or are in uniformly overlapping configuration.

The winding 16 extends to the upper, shaft and extremity 20 of handle 15 adjacent shank portion 17 of the racket. At said upper extremity of the winding, the tether lines 11 are wound circumferentially with tension about the handle, and a piece of elastic adhesive tape 18 is wound circumferentially with tension about said tether lines to anchor them in place. At the upper, shaft end extremity 20 of the winding, the strip is perpendicularly disposed to the handle axis by consequence of the tapered portion. It is important to note that, even if the strip were to be reversed so that its opposite surface were outwardly disposed as the gripping surface, both upper and lower extremities of the winding would still be perpendicularly disposed to the handle axis. The outwardly disposed surface of the winding constitutes the gripping surface.

By virtue of the construction of the aforesaid covering and its manner of attachment to a handle, there is provided a cushioned gripping surface relatively unaffected by moisture, and preserving the natural "feel" of the handle. Stability toward torsional stresses is not sacrificed in view of the critical features of construction of the covering and its anchored engagement with the underlying leather or rubber non-slip primary covering on the handle.

The secondary covering can be removed, washed, and re-applied to the handle. However, because of the low cost of the covering and the player's possible desire for a changed handle appearance, old coverings may be easily replaced with new ones.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A secondary covering for the gripped portion of a manipulative shaft-like handle having a primary non-slip covering, said secondary covering comprising an elongated strip of terrycloth fabric having two edges that extend along the length of said strip, said two edges converging toward each other at each extremity of said strip, said strip further comprising two lengths of strong thin tether line attached to each extremity.

2. The secondary covering of claim 1 wherein said edges of said strip comprise two straight parallel edges, defining a uniform width of between ½ and 1½".

3. The secondary covering of claim 2 wherein the edges of said strip are provided with a stitching which prevents unravelling.

4. The secondary covering of claim 3 wherein each of the two opposing surfaces of the strip have different textures.

5. The secondary covering of claim 3 wherein said strip has a length between about 25" and 50".

6. The secondary covering of claim 5 wherein said terrycloth fabric is a woven fabric of cotton having surface loops, a basis weight between about 10 oz. and 15 oz. per square yard, and a thickness between 0.01 and 0.03 inch.

7. The secondary covering of claim 6 wherein said tether lines are heavy denier continuous multi-filament crimped synthetic yarns capable of compressing onto and frictionally engaging said primary non-slip covering.

8. The secondary covering of claim 7 wherein the converging edges at each extremity of the strip terminate in an apex forming an angle of about 20 degrees with respect to the longitudinal midline of said strip, said tapered portion having a length between about 1½ and 5 inches.

9. A manipulative shaft-like handle having a free bottom extremity, upper extremity and primary non-slip covering, and a secondary covering applied upon said primary covering, said secondary covering comprising an elongated strip of terrycloth fabric having two edges that extend along the length of said strip, said two edges converging toward each other at each extremity of said strip, said strip also having two lengths of strong thin tether line attached to each extremity, said strip being wound in spiral pattern upon said handle beginning at the bottom extremity thereof where the strip covers said tether lines, and terminating at the upper extremity of the handle where the tether lines are circumferentially wrapped about said handle and secured with a resilient tape.

* * * * *